US009847614B1

(12) United States Patent
Wu et al.

(10) Patent No.: US 9,847,614 B1
(45) Date of Patent: Dec. 19, 2017

(54) RECEPTACLE CONNECTOR

(71) Applicant: Cheng Uei Precision Industry Co., Ltd., New Taipei (TW)

(72) Inventors: Yun Wu, Dong-Guan (CN); Kai-Hsiang Chang, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/379,288

(22) Filed: Dec. 14, 2016

(51) Int. Cl.

| | |
|---|---|
| ***H01R 13/6585*** | (2011.01) |
| ***H01R 24/64*** | (2011.01) |
| ***H01R 13/6581*** | (2011.01) |
| ***H01R 12/75*** | (2011.01) |
| *H01R 107/00* | (2006.01) |

(52) U.S. Cl.
CPC ..... *H01R 24/64* (2013.01); *H01R 12/75* (2013.01); *H01R 13/6581* (2013.01); *H01R 2107/00* (2013.01)

(58) Field of Classification Search
USPC ..... 439/607.4, 607.35, 660
See application file for complete search history.

(56) References Cited

U.S. PATENT DOCUMENTS 6,685,486 B1 * 2/2004 Zhang ..... H01R 13/6215 439/79
7,670,156 B2 * 3/2010 Chen ..... H01R 13/6485 439/108
7,748,999 B1 * 7/2010 Sun ..... H01R 13/506 439/607.36
8,025,532 B2 * 9/2011 Nagata ..... H01R 13/506 439/607.4
8,430,692 B2 * 4/2013 Peng ..... H01R 13/518 439/607.46
8,968,031 B2 * 3/2015 Simmel ..... H01R 13/659 439/108
9,088,108 B2 * 7/2015 Zhao ..... H01R 13/6581
9,281,629 B2 * 3/2016 Little ..... H01R 13/6583
9,281,643 B1 * 3/2016 Tseng ..... H01R 13/518
9,379,499 B2 * 6/2016 Miyoshi ..... H01R 24/60
9,431,746 B2 * 8/2016 Wu ..... H01R 13/443
9,461,415 B2 * 10/2016 Guo ..... H01R 13/41
9,466,924 B2 * 10/2016 Lin ..... H01R 13/6585
9,484,679 B2 * 11/2016 Guo ..... H01R 13/6585
(Continued)

*Primary Examiner* — Neil Abrams
(74) *Attorney, Agent, or Firm* — Cheng-Ju Chiang

(57) ABSTRACT

A receptacle connector includes an insulating housing, a plurality of conductive terminals fastened to the insulating housing, and a shielding element surrounding the insulating housing. The insulating housing has at least one docking surface. A portion of the at least one docking surface protrudes outward to form a protruding portion. Front ends of the conductive terminals are exposed to a front of the at least one docking surface. At least one portion of a front surface of the base body protrudes frontward to form at least one sealing board. A front end of the at least one sealing board opens a locking groove. The at least one sealing board is attached to a substantial middle of the insulating housing. The protruding portion is received in the locking groove and seals up the front end of the at least one sealing board. The protruding portion helps to reduce metal chips from being produced during interconnection of the receptacle connector with a plug connector.

20 Claims, 9 Drawing Sheets

(56) References Cited

U.S. PATENT DOCUMENTS

| | | | | |
|---|---|---|---|---|
| 9,496,664 | B2 * | 11/2016 | Little | H01R 13/6587 |
| 9,525,244 | B1 * | 12/2016 | Hsu | H01R 13/6585 |
| 9,667,001 | B2 * | 5/2017 | Zhao | H01R 13/6581 |
| 9,673,569 | B2 * | 6/2017 | Zhang | H01R 13/6585 |
| 9,698,536 | B2 * | 7/2017 | Little | H01R 13/6583 |
| 9,705,267 | B2 * | 7/2017 | Cheng | H01R 24/60 |
| 9,711,910 | B2 * | 7/2017 | Zhao | H01R 13/5202 |
| 2015/0295356 | A1 * | 10/2015 | Tziviskos | H01R 24/64 439/248 |
| 2015/0295362 | A1 * | 10/2015 | Tziviskos | H01R 13/6581 439/607.01 |
| 2016/0064869 | A1 * | 3/2016 | Yu | H01R 24/60 439/607.05 |
| 2016/0099523 | A1 * | 4/2016 | Miyoshi | H01R 13/428 439/676 |

* cited by examiner

RECEPTACLE CONNECTOR

BACKGROUND OF THE INVENTION

1. Field of the Invention

The present invention generally relates to a connector, and more particularly to a receptacle connector capable of effectively preventing a short circuit being caused.

2. The Related Art

With the development of various electronic products, the various electronic products are connected with peripheral devices more and more frequently, and the various electronic products are usually connected with the peripheral devices by electrical connectors.

Referring to FIG. 8 and FIG. 9, an existing receptacle connector 100' includes an insulating housing 10', two groups of conductive terminals 20' and a shielding element 30'. The insulating housing 10' has a main portion 11', a first tongue portion 12' protruded frontward from a front surface of the main portion 11', and a second tongue portion 13' protruded frontward from a front surface of the first tongue portion 12'. The two groups of the conductive terminals 20' are fastened to the insulating housing 10'. Front ends of one group of the conductive terminals 20' are exposed to a top surface of the second tongue portion 13' and are arranged transversely. Front ends of the other group of the conductive terminals 20' are exposed to a bottom surface of the second tongue portion 13' and are arranged transversely. Rear ends of the two groups of the conductive terminals 20' project beyond a rear surface of the main portion 11'.

The shielding element 30' is formed by virtue of a MIM (Metal Injection Molding) technology. The shielding element 30' has a base portion 31'. The base portion 31' opens a receiving chamber 32' penetrating through a front surface and a rear surface thereof. Two opposite sides of the front surface of the base portion 31' protrude frontward to form two side boards 33'. The receiving chamber 32' is located between the two side boards 33'. A top and a bottom of the front surface of the base portion 31' protrude frontward to form two sealing boards 34'. The two sealing boards 34' are connected with top surfaces and bottom surfaces of the two side boards 33', respectively. The main portion 11' is received in the receiving chamber 32'. The first tongue portion 12' and the second tongue portion 13' are received between the two side boards 33'. The two sealing boards 34' are respectively attached to a top surface and a bottom surface of the first tongue portion 12'. The front surface of the first tongue portion 12' is flush with front surfaces of the two sealing boards 34'.

However, after the receptacle connector 100' is docked with a plug connector frequently, metal chips are easily produced from the two sealing boards 34' on account of a friction between the two sealing boards 34' and the plug connector, and front ends of the two sealing boards 34' are nearer to exposing portions of the two groups of the conductive terminals 20', so the metal chips easily fall down on the conductive terminals 20' to cause the conductive terminals 20' to be electrically connected with the two sealing boards 34' by the metal chips. As a result, the receptacle connector 100' easily causes a short circuit.

SUMMARY OF THE INVENTION

An object of the present invention is to provide a receptacle connector adapted for being interconnected with a plug connector. The receptacle connector includes an insulating housing, a plurality of conductive terminals and a shielding element. The insulating housing has at least one docking surface for being docked with the plug connector. A portion of the at least one docking surface protrudes outward to form a protruding portion beyond the at least one docking surface. The plurality of conductive terminals are fastened to the insulating housing. Front ends of the conductive terminals are exposed to a front of the at least one docking surface and are transversely arranged along the at least one docking surface. The front ends of the conductive terminals are located in front of the protruding portion. Rear ends of the conductive terminals project beyond a rear surface of the insulating housing. The shielding element surrounds the insulating housing. The shielding element has a base body which opens a receiving chamber penetrating through a front surface and a rear surface of the base body. Two opposite sides of the front surface of the base body extend frontward to form two side boards spaced from each other. A front of the receiving chamber is located between the two side boards. At least one portion of the front surface of the base body protrudes frontward to form at least one sealing board connected with rears of the two side boards. A front end of the at least one sealing board opens a locking groove. A rear of the insulating housing is fastened in the receiving chamber. A front of the insulating housing is received between fronts of the two side boards. The front ends of the conductive terminals are exposed out of the shielding element. The rear ends of the conductive terminals project out of the shielding element. The at least one sealing board is attached to a substantial middle of the insulating housing and located behind the protruding portion. The protruding portion is received in the locking groove and seals up the front end of the at least one sealing board.

As described above, the protruding portion of the at least one docking surface is received in the locking groove of the at least one sealing board, and seals up the front end of the at least one sealing board, the front ends of the conductive terminals are exposed to the front of the at least one docking surface and are transversely arranged along the at least one docking surface, the front ends of the conductive terminals exposed to the front of the at least one docking surface are defined as exposing portions of the conductive terminals, the exposing portions of the conductive terminals are located in front of the protruding portion, the front end of the at least one sealing board is isolated from the exposing portions of the conductive terminals by the protruding portion, so a distance between the exposing portions and the front end of the at least one sealing board is increased, and after the receptacle connector is docked with the plug connector frequently, metal chips produced from the at least one sealing board on account of a friction between the at least one sealing board and the plug connector are effectively decreased, so that the metal chips are prevented from falling down on the conductive terminals to make the conductive terminals be electrically connected with the at least one sealing board. As a result, the receptacle connector is capable of effectively preventing a short circuit being caused.

BRIEF DESCRIPTION OF THE DRAWINGS

The present invention will be apparent to those skilled in the art by reading the following description, with reference to the attached drawings, in which.

DETAILED DESCRIPTION OF THE PREFERRED EMBODIMENT

Figure 1:
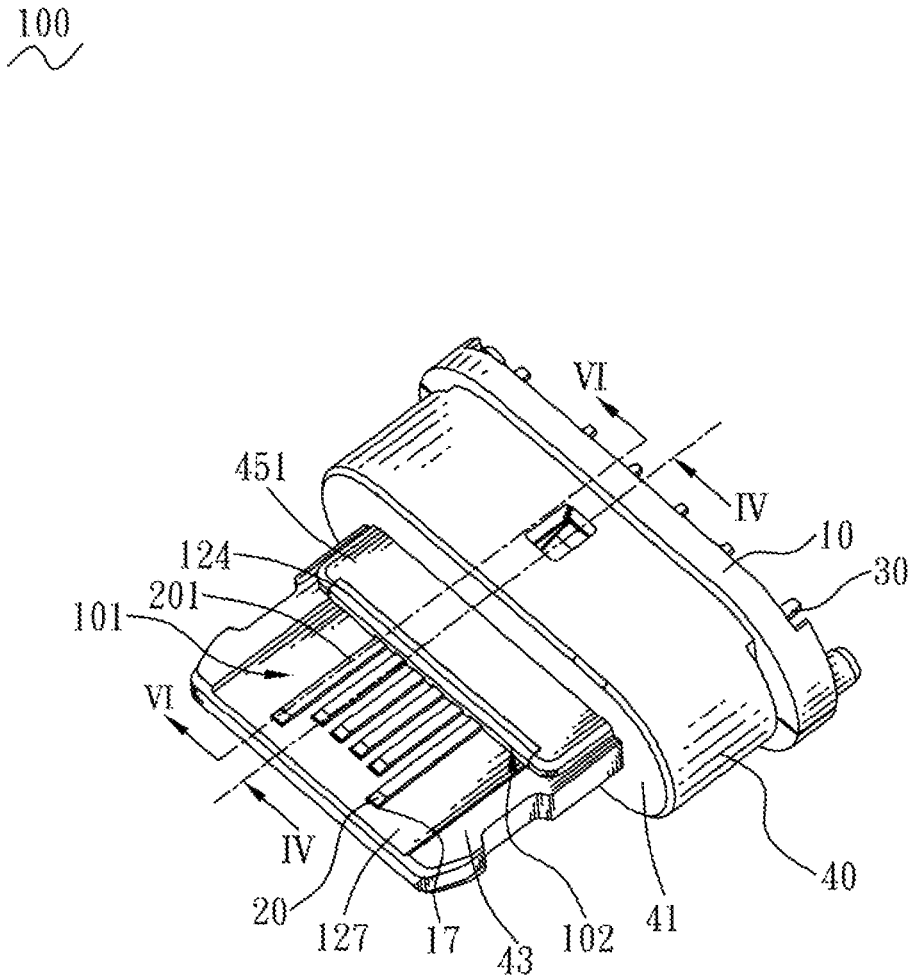
FIG. 1 is a perspective view of a receptacle connector in accordance with the present invention.
Figure 3:
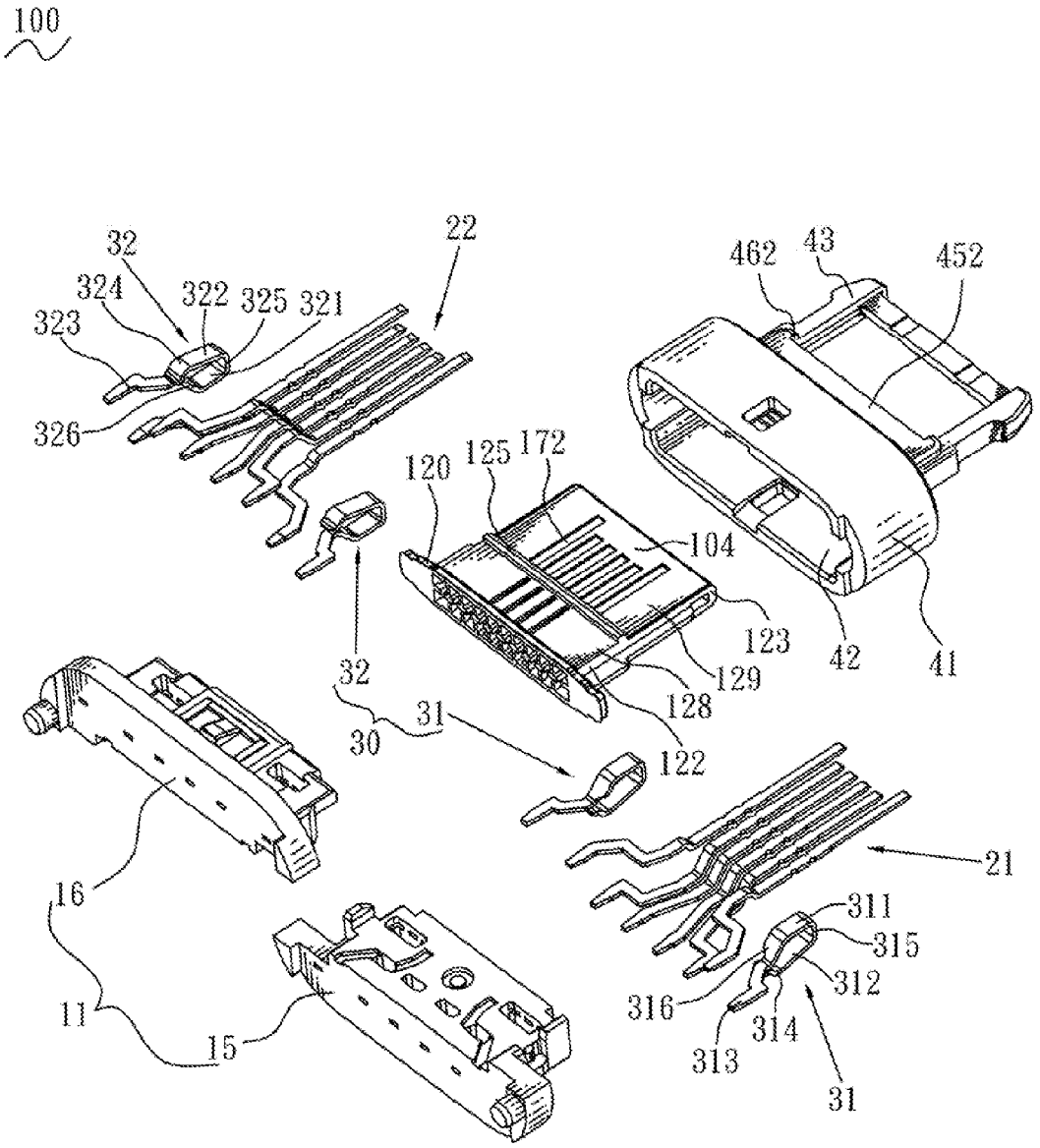
FIG. 3 is another exploded perspective view of the receptacle connector of FIG. 1.
Figure 4:
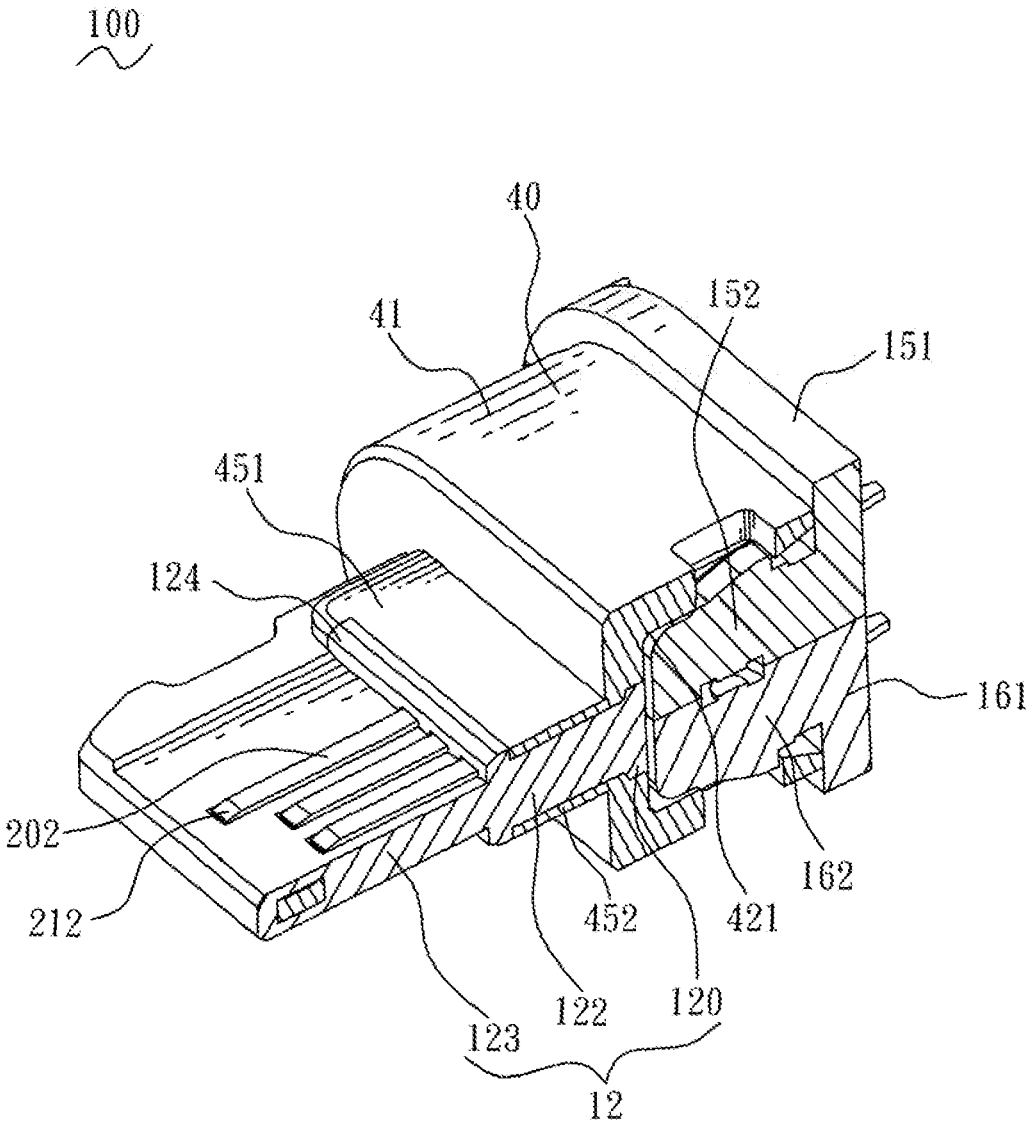
FIG. 4 is a sectional perspective view of the receptacle connector along a line IV-IV of FIG. 1.
Figure 5:
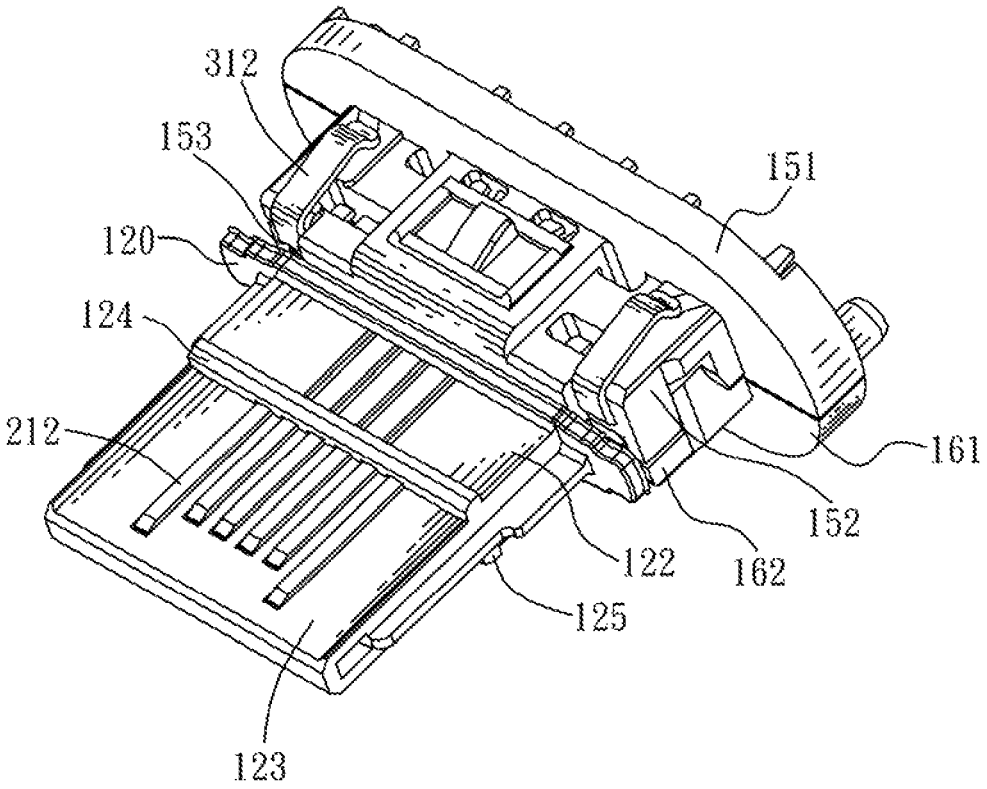
FIG. 5 is a partially perspective view of the receptacle connector of FIG. 1, wherein a shielding element is omitted.

With reference to FIG. 1 and FIG. 3, a receptacle connector 100 in accordance with the present invention is shown. The receptacle connector 100 adapted for being interconnected with a plug connector (not shown), includes an insulating housing 10, a plurality of conductive terminals 20, at least one ground terminal 30 and a shielding element 40.

Referring to FIG. 1 to FIG. 4, the insulating housing 10 includes a main portion 11, and a tongue portion 12 fastened to a front end of the main portion 11. A direction of the plug connector being plugged into the receptacle connector 100 is defined as a front-to-rear direction, namely a longitudinal direction. Correspondingly, a transverse direction is defined as a direction perpendicular to the longitudinal direction. The main portion 11 has a base portion 13, and a connecting portion 14 protruded frontward from a middle of a front surface of the base portion 13. Specifically, the main portion 11 includes an upper insulating body 15, and a lower insulating body 16 matched with the upper insulating body 15. The upper insulating body 15 has an upper base portion 151, and an upper connecting portion 152 protruded frontward from a lower portion of a front surface of the upper base portion 151. Two opposite sides of a front surface of the upper connecting portion 152 are recessed inward to form two upper gaps 153.

The lower insulating body 16 has a lower base portion 161, and a lower connecting portion 162 protruded frontward from an upper portion of a front surface of the lower base portion 161. Two opposite sides of a front surface of the lower connecting portion 162 are recessed inward to form two lower gaps 163. The upper base portion 151 and the lower base portion 161 are matched with each other. The upper base portion 151 and the lower base portion 161 together define the base portion 13. The upper connecting portion 152 and the lower connecting portion 162 are matched with each other. The upper connecting portion 152 and the lower connecting portion 162 together define the connecting portion 14.

Figure 2:
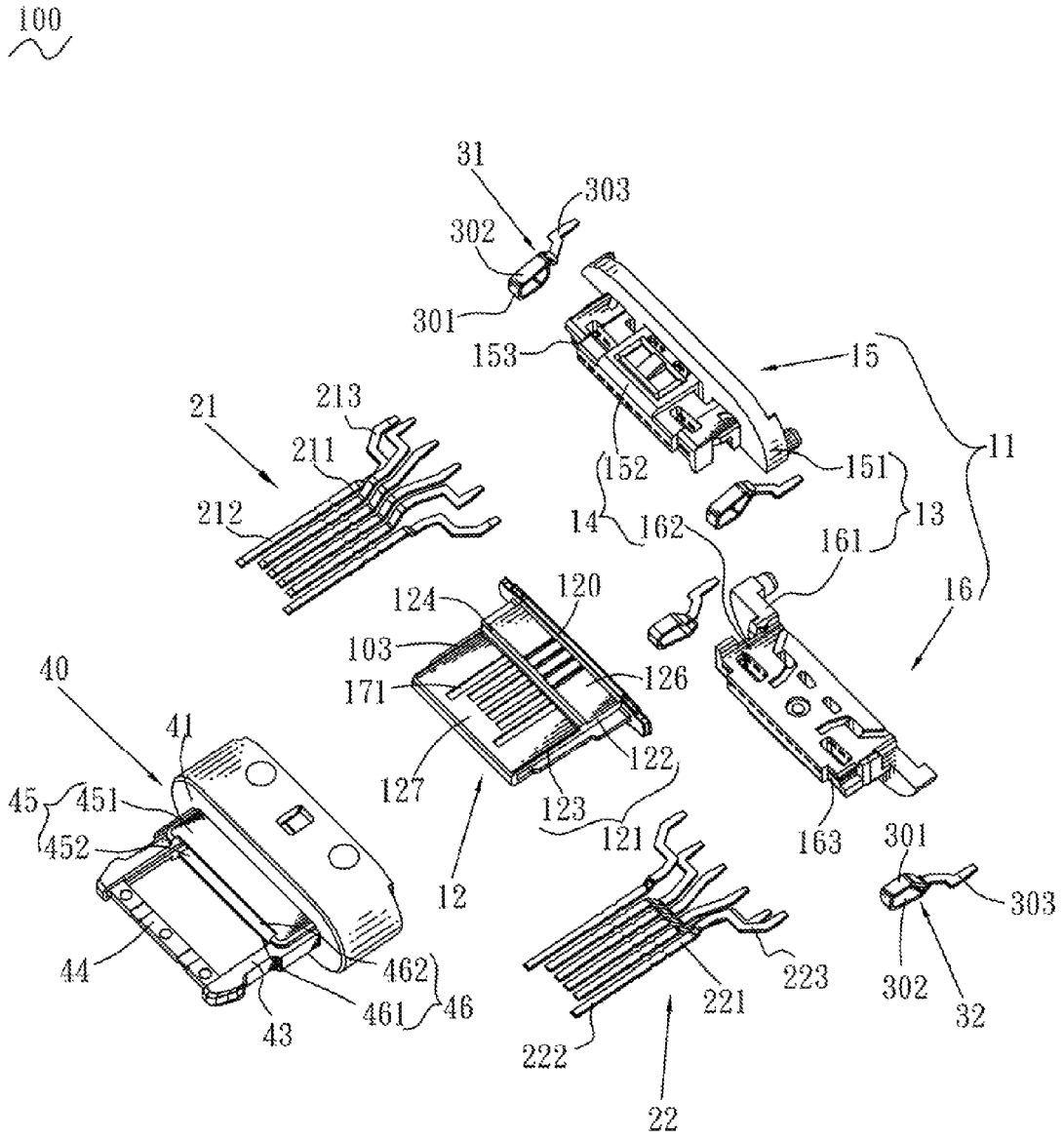
FIG. 2 is an exploded perspective view of the receptacle connector of FIG. 1.

Referring to FIG. 1 to FIG. 3, the tongue portion 12 has a limiting portion 120, and a docking portion 121 protruded frontward from a front surface of the limiting portion 120. The docking portion 121 has a first docking portion 122 protruded frontward from the front surface of the limiting portion 120, and a second docking portion 123 protruded frontward from a front face of the first docking portion 122. The docking portion 121 of the tongue portion 12 of the insulating housing 10 has at least one docking surface 101 for being docked with the plug connector. A portion of the at least one docking surface 101 protrudes outward to form a protruding portion 102 beyond the at least one docking surface 101. The tongue portion 12 opens a plurality of terminal grooves 17 longitudinally extending and penetrating through a rear surface thereof, and penetrating through a front of the at least one docking surface 101. The terminal grooves 17 are located in front of the protruding portion 102 and transversely arranged along the at least one docking surface 101.

Preferably, the docking portion 121 protruded frontward from a middle of the front surface of the limiting portion 120. The docking portion 121 has the first docking portion 122 protruded frontward from a middle of the front surface of the limiting portion 120, and the second docking portion 123 protruded frontward from a middle of the front face of the first docking portion 122. The insulating housing 10 has two opposite docking surfaces 101. A top surface 103 and a bottom surface 104 of the docking portion 121 are defined as the two opposite docking surfaces 101. Substantial middles of the two opposite docking surfaces 101 protrude outward to form two protruding portions 102 beyond the two opposite docking surfaces 101, respectively. The two protruding portions 102 include a first protruding portion 124 and a second protruding portion 125. A substantial middle of the top surface 103 protrudes outward to form the first protruding portion 124 beyond the top surface 103. A substantial middle of the bottom surface 104 protrudes outward and opposite to the first protruding portion 124 to form the second protruding portion 125 beyond the bottom surface 104.

Specifically, one of the two opposite docking surfaces 101 includes a top face 126 of the first docking portion 122 extending longitudinally, and a superface 127 of the second docking portion 123 extending longitudinally, and located in front of the top face 126 of the first docking portion 122. The other docking surface 101 includes a bottom face 128 of the first docking portion 122 opposite to the top face 126 of the first docking portion 122, and a subface 129 of the second docking portion 123 opposite to the superface 127 of the second docking portion 123. Front ends of the top face 126 and the bottom face 128 of the first docking portion 122 protrude outward to form the first protruding portion 124 and the second protruding portion 125, respectively. The first protruding portion 124 and the second protruding portion 125 extend transversely and are of elongated shapes. The first protruding portion 124 and the second protruding portion 125 are shown as the same shape and the same size.

The terminal grooves 17 are arranged in two rows along an up-down direction perpendicular to both the longitudinal direction and the transverse direction. Correspondingly, a vertical direction is defined as a direction perpendicular to both the longitudinal direction and the transverse direction. Each row of the terminal grooves 17 are arranged transversely. The two rows of the terminal grooves 17 include a row of upper terminal grooves 171, and a row of lower terminal grooves 172 located under the row of the upper terminal grooves 171. The row of the upper terminal grooves 171 longitudinally extend and penetrate through the rear surface of the tongue portion 12, and vertically penetrate through the superface 127 of the second docking portion 123. The row of the lower terminal grooves 172 longitudinally extend and penetrate through the rear surface of the tongue portion 12, and vertically penetrate through the subface 129 of the second docking portion 123.

Figure 6:
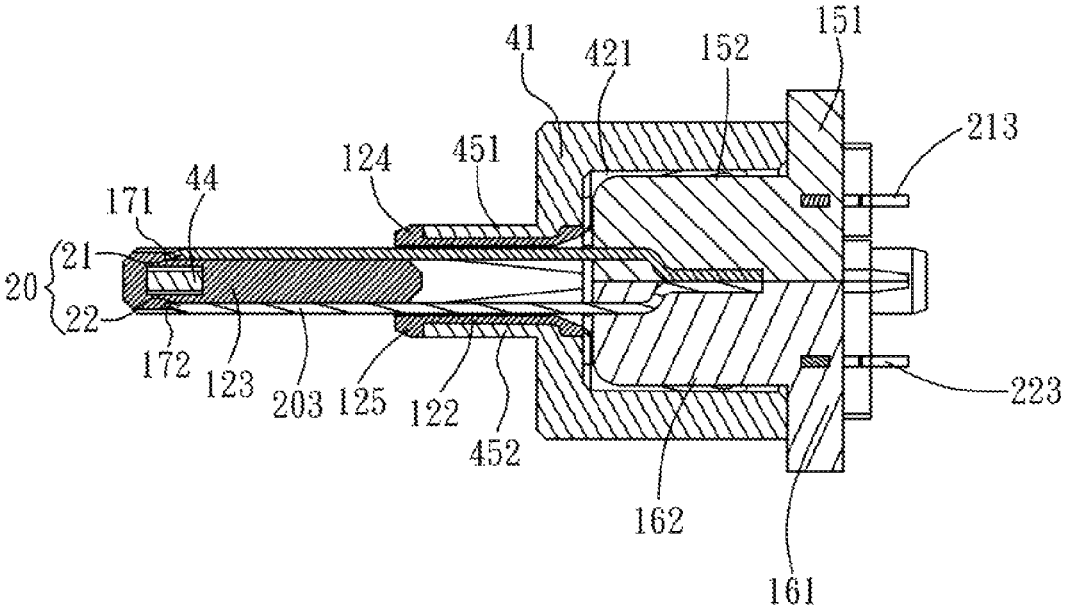
FIG. 6 is a sectional view of the receptacle connector along a line VI-VI of FIG. 1.

Referring to FIG. 2 and FIG. 6, the plurality of conductive terminals 20 include a plurality of upper terminals 21 and a plurality of lower terminals 22. Each of the upper terminals 21 has an upper fastening portion 211, an upper contact portion 212 extended frontward from a front end of the upper fastening portion 211, and an upper soldering portion 213 extended rearward from a rear end of the upper fastening portion 211. Each of the lower terminals 22 has a lower fastening portion 221, a lower contact portion 222 extended frontward from a front end of the lower fastening portion 221, and a lower soldering portion 223 extended rearward from a rear end of the lower fastening portion 221.

Referring to FIG. 2 and FIG. 3, the at least one ground terminal 30 has a fixing portion 301, a touching portion 302 connected with one end of the fixing portion 301, and a soldering foot 303 connected with the other end of the fixing portion 301.

Preferably, the receptacle connector 100 includes two pairs of ground terminals 30. The two pairs of ground terminals 30 include two upper ground terminals 31 and two lower ground terminals 32. Each of the two upper ground terminals 31 has an upper fixing portion 311, an upper touching portion 312 connected with one end of the upper fixing portion 311, and an upper soldering foot 313 connected with the other end of the upper fixing portion 311. Specifically, the upper fixing portion 311 is shown as a substantially U shape with the mouth thereof facing upward. The substantially U-shaped upper fixing portion 311 has a first arm 315, and a second arm 316 inclined outward away from the first arm 315 and located behind the first arm 315. The upper touching portion 312 is slantwise extended upward and rearward from the first arm 315, and located above the inclined second arm 316 and a middle of the upper fixing portion 311. The upper soldering foot 313 is bent rearward, then slantwise extends rearward and sideward, and further extends rearward from the second arm 316. A free end of the upper touching portion 312 is bent downward and rearward, and then is arched downward to form an upper touching point 314 approaching to a root portion of the upper soldering foot 313.

Each of the two lower ground terminals 32 has a lower fixing portion 321, a lower touching portion 322 connected with one end of the lower fixing portion 321, and a lower soldering foot 323 connected with the other end of the lower fixing portion 321. Specifically, the lower fixing portion 321 is shown as a substantially inverted U shape with the mouth thereof facing downward. The substantially inverted U-shaped lower fixing portion 321 has a third arm 325, and a fourth arm 326 inclined outward away from the third arm 325 and located behind the third arm 325. The lower touching portion 322 is slantwise extended downward and rearward from the third arm 325 and located under the inclined fourth arm 326 and a middle of the lower fixing portion 321. The lower soldering foot 323 is bent rearward in a direction away from the third arm 325, then slantwise extends rearward and sideward, and further extends rearward from the fourth arm 326. A free end of the lower touching portion 322 is bent upward and rearward, and then is arched upward to form a lower touching point 324 approaching to a root portion of the lower soldering foot 323.

Figure 7:
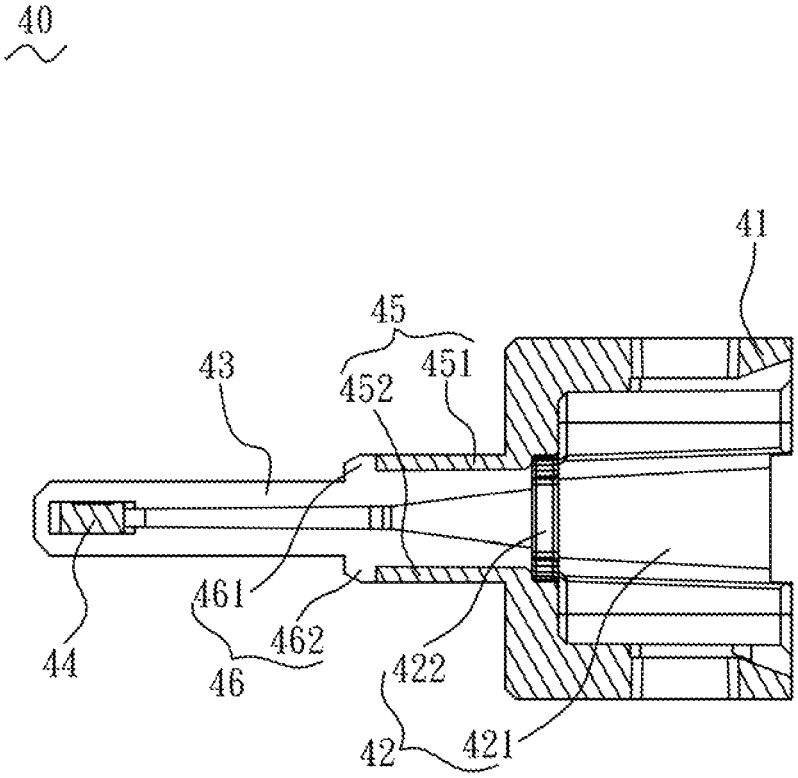
FIG. 7 is a sectional view of the shielding element of the receptacle connector of FIG. 1.
Figure 8:
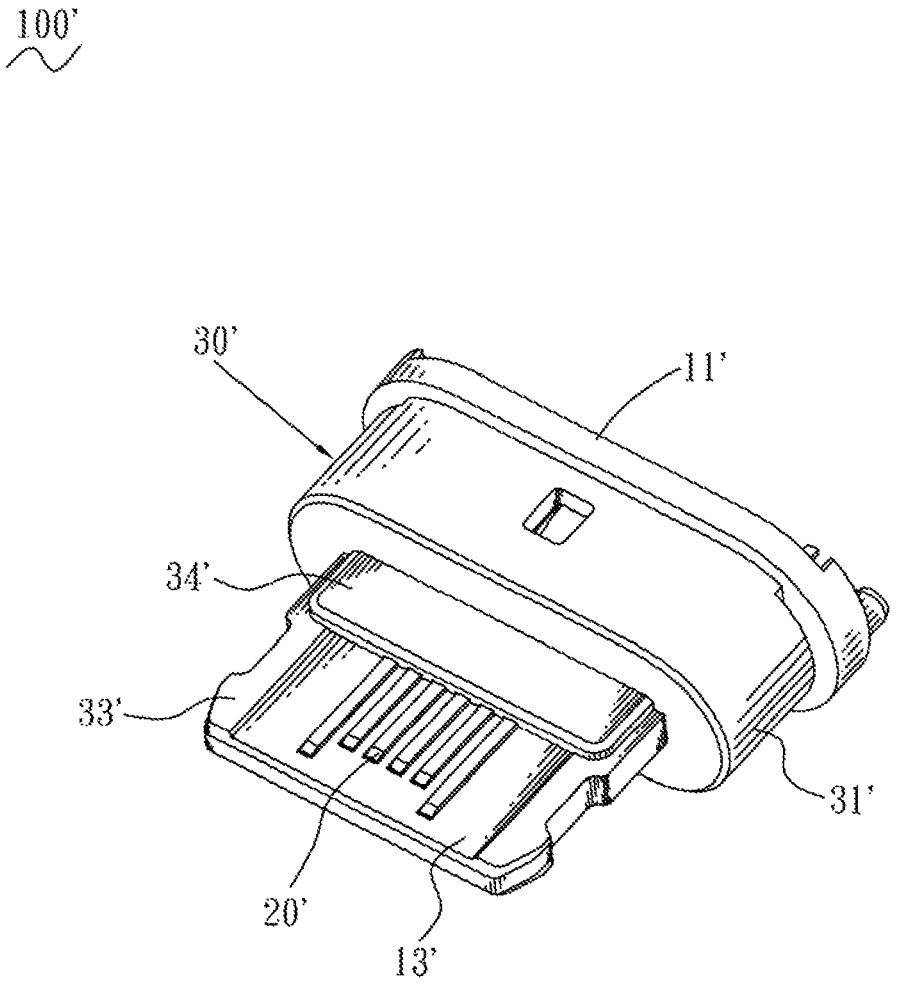
FIG. 8 (Prior Art)
FIG. 8 is a perspective view of a receptacle connector in prior art.
Figure 9:
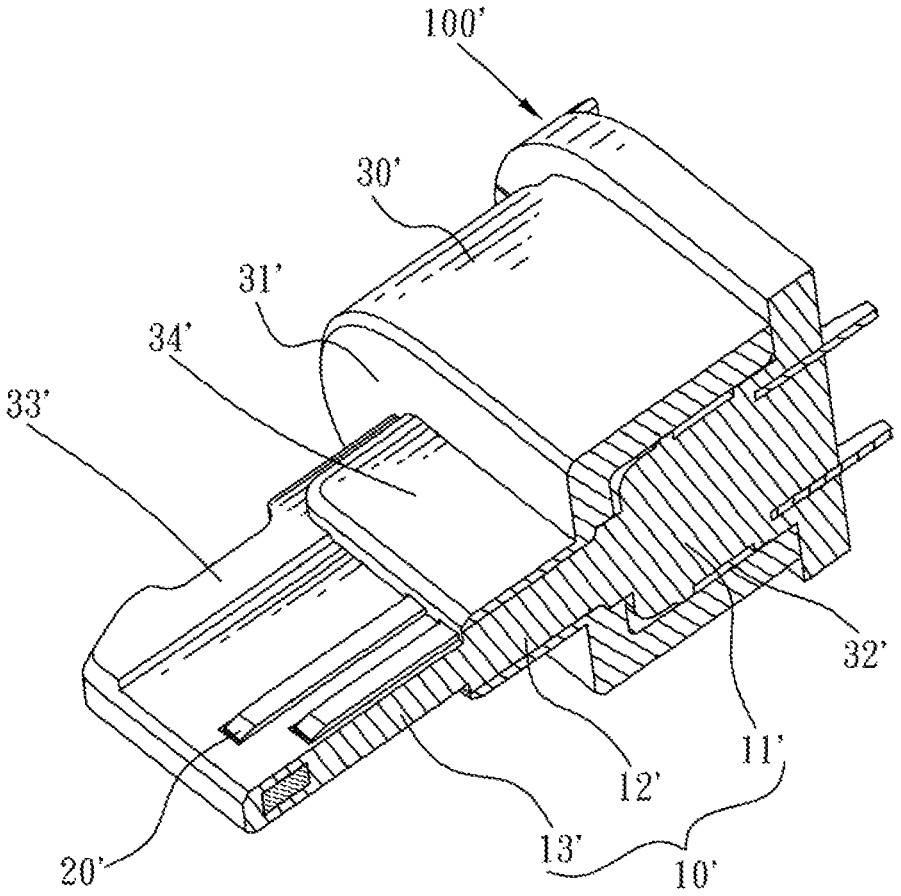
FIG. 9 (Prior Art)
FIG. 9 is a sectional perspective view of the receptacle connector of FIG. 8.

Referring to FIG. 2, FIG. 3 and FIG. 7, the shielding element 40 is formed by a MIM (Metal Injection Molding) technology. The shielding element 40 has a base body 41. The base body 41 opens a receiving chamber 42 penetrating through a front surface and a rear surface thereof. The receiving chamber 42 includes a first receiving chamber 421 and a second receiving chamber 422. A rear of the base body 41 opens the first receiving chamber 421 passing through the rear surface of the base body 41. A front wall of the first receiving chamber 421 opens the second receiving chamber 422 passing through the front surface of the base body 41. The second receiving chamber 422 is located in front of and communicated with the first receiving chamber 421. Two opposite sides of the front surface of the base body 41 extend frontward to form two side boards 43 spaced from each other. A front of the receiving chamber 42 is located between the two side boards 43. The second receiving chamber 422 of the receiving chamber 42 is located between the two side boards 43.

The shielding element 40 further has a connecting board 44 connected between front ends of the two side boards 43. At least one portion of the front surface of the base body 41 protrudes frontward to form at least one sealing board 45 connected with rears of the two side boards 43. A front end of the at least one sealing board 45 opens a locking groove 46.

Specifically, the shielding element 40 has two sealing boards 45. The front ends of the two sealing boards 45 open two locking grooves 46, respectively. An upper portion of the front surface of the base body 41 protrudes frontward to form a first sealing board 451. Two opposite sides of the first sealing board 451 are connected with rears of top surfaces of the two side boards 43. A middle of a front end of the first sealing board 451 opens a first locking groove 461. A lower portion of the front surface of the base body 41 protrudes frontward to form a second sealing board 452 opposite to and spaced from the first sealing board 451. Two opposite sides of the second sealing board 452 are connected with rears of bottom surfaces of the two side boards 43. A middle of a front end of the second sealing board 452 opens a second locking groove 462. The two sealing boards 45 include the first sealing board 451 and the second sealing board 452. The two locking grooves 46 include the first locking groove 461 and the second locking groove 462.

Referring to FIG. 1 to FIG. 7, the plurality of conductive terminals 20 and the at least one ground terminal 30 are fastened to the base portion 13 and the connecting portion 14 of the main portion 11 of the insulating housing 10. And the plurality of conductive terminals 20 are transversely arranged along the at least one docking surface 101. Front ends of the plurality of conductive terminals 20 and the at least one ground terminal 30 project beyond a front surface of the main portion 11. The front ends of the plurality of conductive terminals 20 and the at least one ground terminal 30 project beyond a front surface of the connecting portion 14. Rear ends of the plurality of conductive terminals 20 and the at least one ground terminal 30 project beyond a rear surface of the insulating housing 10. The rear ends of the plurality of conductive terminals 20 and the at least one ground terminal 30 project beyond a rear surface of the main portion 11. The rear ends of the plurality of conductive terminals 20 and the at least one ground terminal 30 project beyond a rear surface of the base portion 13.

The upper terminals 21 and the lower terminals 22 are fastened to the insulating housing 10. Rear ends of the upper terminals 21 and the lower terminals 22 project beyond the rear surface of the insulating housing 10. Front ends of the upper terminals 21 are exposed to one of the two opposite docking surfaces 101 and located in front of the first protruding portion 124. Front ends of the lower terminals 22 are exposed to the other docking surface 101 and located in front of the second protruding portion 125.

Specifically, the upper terminals 21 are integrally molded to the upper insulating body 15 and arranged transversely. The upper fastening portions 211 of the upper terminals 21 are integrally molded in the upper insulating body 15. The upper contact portions 212 of the upper terminals 21 project beyond the front surface of the upper connecting portion 152. The upper soldering portions 213 of the upper terminals 21 project beyond a rear surface of the upper base portion 151. The two upper ground terminals 31 are integrally molded to the upper insulating body 15. The upper terminals 21 are located between the two upper ground terminals 31. Rear ends and the middles of the upper fixing portions 311 and front ends of the upper soldering feet 313 of the two upper ground terminals 31 are molded in the upper insulating body 15. Front ends of the upper fixing portions 311 of the two upper ground terminals 31 are fastened in the two upper gaps 153. The first arms 315 of the upper fixing portions 311 are fastened in the two upper gaps 153, respectively. Rear ends of the upper soldering feet 313 of the two upper ground terminals 31 project beyond the rear surface of the upper base portion 151. The upper touching portions 312 of the two upper ground terminals 31 project beyond a top surface of the upper connecting portion 152. The upper touching points 314 of the two upper ground terminals 31 abut against an inner surface of a top wall of the receiving chamber 42.

The lower terminals 22 are integrally molded to the lower insulating body 16 and arranged transversely. The lower fastening portions 221 of the lower terminals 22 are integrally molded in the lower insulating body 16. The lower contact portions 222 of the lower terminals 22 project beyond the front surface of the lower connecting portion 162. The lower soldering portions 223 of the lower terminals 22 project beyond a rear surface of the lower base portion 161. The two lower ground terminals 32 are integrally molded to the lower insulating body 16. The lower terminals 22 are located between the two lower ground terminals 32. Rear ends and the middles of the lower fixing portions 321 and front ends of the lower soldering feet 323 of the two lower ground terminals 32 are molded in the lower insulating body 16. Front ends of the lower fixing portions 321 of the two lower ground terminals 32 are fastened in the two lower gaps 163. The third arms 325 of the lower fixing portions 321 are fastened in the two lower gaps 163, respectively. Rear ends of the lower soldering feet 323 of the two lower ground terminals 32 project beyond the rear surface of the lower base portion 161. The lower touching portions 322 of the two lower ground terminals 32 project beyond a top surface of the lower connecting portion 162. The lower touching points 324 of the two lower ground terminals 32 abut against an inner surface of a bottom wall of the receiving chamber 42.

The shielding element 40 surrounds the insulating housing 10. A rear of the insulating housing 10 is fastened in the receiving chamber 42. A front of the insulating housing 10 is received between fronts of the two side boards 43. The tongue portion 12 is integrally molded with the shielding element 40. A rear of the tongue portion 12 is fastened in the second receiving chamber 422. A front of the tongue portion 12 is received between the two side boards 43. The at least one sealing board 45 is attached to a substantial middle of the insulating housing 10 and located behind the protruding portion 102. The at least one sealing board 45 is attached to a rear of the at least one docking surface 101. The protruding portion 102 of the at least one docking surface 101 is received in the locking groove 46 of the at least one sealing board 45, and seals up the front end of the at least one sealing board 45. A front surface of the protruding portion 102 is flush with a front surface of the at least one sealing board 45.

Specifically, the limiting portion 120 is fastened in the second receiving chamber 422. The docking portion 121 is received between the two side boards 43. A front surface of the second docking portion 123 is flush with front surfaces of the two side boards 43. The connecting board 44 is fastened in the front of the insulating housing 10. The connecting board 44 is fastened in the second docking portion 123. The first sealing board 451 is attached to a rear of one of the two opposite docking surfaces 101. The first sealing board 451 is attached to a rear of the top face 126 of the first docking portion 122. The first protruding portion 124 is received in the first locking groove 461 and seals up the front end of the first sealing board 451. The second sealing board 452 is attached to a rear of the other docking surface 101. The second sealing board 452 is attached to a rear of the bottom face 128 of the first docking portion 122. The second protruding portion 125 is received in the second locking groove 462 and seals up the front end of the second sealing board 452. Front surfaces of the first protruding portion 124 are flush with front surfaces of the two opposite sides of the first sealing board 451. Front surfaces of the second protruding portion 125 are flush with front surfaces of the two opposite sides of the second sealing board 452. So when the receptacle connector 100 is interconnected with the plug connector, metal chips produced from the at least one sealing board 45 on account of a friction between the at least one sealing board 45 and the plug connector are effectively decreased.

A front of the main portion 11 is received in the first receiving chamber 421. A rear of the tongue portion 12 is received in the second receiving chamber 422. The tongue portion 12 is fastened to the front of the main portion 11. The connecting portion 14 is received in the first receiving chamber 421. The front surface of the base portion 13 abuts against the rear surface of the base body 41. The upper base portion 151 is fastened to the lower base portion 161 to form the base portion 13. The upper connecting portion 152 is fastened to the lower connecting portion 162 to form the connecting portion 14. The upper connecting portion 152 and the lower connecting portion 162 are received in the first receiving chamber 421. Front surfaces of the upper base portion 151 and the lower base portion 161 abut against the rear surface of the base body 41.

The front ends of the plurality of conductive terminals 20 are fastened to the tongue portion 12. The front ends of the plurality of conductive terminals 20 are inserted frontward into the terminal grooves 17. The front ends of the conductive terminals 20 are exposed to a front of the at least one docking surface 101 from front ends of the respective terminal grooves 17 and are transversely arranged along the at least one docking surface 101. The front ends of the conductive terminals 20 are exposed out of the shielding element 40. The front ends of the conductive terminals 20 are located in front of the protruding portion 102. The front ends of the conductive terminals 20 exposed to the front of the at least one docking surface 101 are defined as exposing portions 201 of the conductive terminals 20. The exposing portions 201 of the conductive terminals 20 are located in front of the protruding portion 102. The front end of the at least one sealing board 45 is isolated from the exposing portions 201 of the conductive terminals 20 by the protruding portion 102, so a distance between the exposing portions 201 and the front end of the at least one sealing board 45 is increased. The rear ends of the plurality of conductive terminals 20 project out of the shielding element 40.

The upper contact portions 212 of the upper terminals 21 are inserted frontward into the upper terminal grooves 171, respectively. Tops of front ends of the upper contact portions 212 are exposed to the superface 127 of the second docking portion 123 from front ends of the upper terminal grooves 171, and are arranged transversely. The tops of the front ends of the upper contact portions 212 exposed to the superface 127 of the second docking portion 123 are defined as upper exposing portions 202. The upper exposing portions 202 of the upper terminals 21 are located in front of the first protruding portion 124. So the middle of the front end of the first sealing board 451 is isolated from the upper exposing portions 202 of the upper terminals 21 by the first protruding portion 124. The upper soldering portions 213 of the upper terminals 21 project out of the shielding element 40.

The lower contact portions 222 of the lower terminals 22 are inserted frontward into the lower terminal grooves 172, respectively. Bottoms of front ends of the lower contact portions 222 are exposed to the subface 129 of the second docking portion 123 from front ends of the lower terminal grooves 172, and are arranged transversely. The bottoms of the front ends of the lower contact portions 222 exposed to the subface 129 of the second docking portion 123 are defined as lower exposing portions 203. The lower exposing portions 203 of the lower terminals 22 are located in front of the second protruding portion 125. So the middle of the front end of the second sealing board 452 is isolated from the lower exposing portions 203 of the lower terminals 22 by the second protruding portion 125. The lower soldering portions 223 of the lower terminals 22 project out of the shielding element 40. The upper touching portions 312 of the two upper ground terminals 31 respectively abut against an inner surface of a top wall of the first receiving chamber 421. The lower touching portions 322 of the two lower ground terminals 32 respectively abut against an inner surface of a bottom wall of the first receiving chamber 421.

As described above, the protruding portion 102 of the at least one docking surface 101 is received in the locking groove 46 of the at least one sealing board 45, and seals up the front end of the at least one sealing board 45, the front ends of the conductive terminals 20 are exposed to the front of the at least one docking surface 101 and are transversely arranged along the at least one docking surface 101, the front ends of the conductive terminals 20 exposed to the front of the at least one docking surface 101 are defined as the exposing portions 201 of the conductive terminals 20, the exposing portions 201 of the conductive terminals 20 are located in front of the protruding portion 102, the front end of the at least one sealing board 45 is isolated from the exposing portions 201 of the conductive terminals 20 by the protruding portion 102, so the distance between the exposing portions 201 and the front end of the at least one sealing board 45 is increased, and after the receptacle connector 100 is docked with the plug connector frequently, the metal chips produced from the at least one sealing board 45 on account of the friction between the at least one sealing board 45 and the plug connector are effectively decreased, so that the metal chips are prevented from falling down on the conductive terminals 20 to make the conductive terminals 20 be electrically connected with the at least one sealing board 45. As a result, the receptacle connector 100 is capable of effectively preventing a short circuit being caused.

What is claimed is:

1. A receptacle connector adapted for being interconnected with a plug connector, comprising:

an insulating housing having at least one docking surface for being docked with the plug connector, a portion of the at least one docking surface protruding outward to form a protruding portion beyond the at least one docking surface;

a plurality of conductive terminals fastened to the insulating housing, front ends of the conductive terminals being exposed to a front of the at least one docking surface and being transversely arranged along the at least one docking surface, the front ends of the conductive terminals being located in front of the protruding portion, rear ends of the conductive terminals projecting beyond a rear surface of the insulating housing; and a shielding element surrounding the insulating housing, the shielding element having a base body which opens a receiving chamber penetrating through a front surface and a rear surface of the base body, two opposite sides of the front surface of the base body extending frontward to form two side boards spaced from each other, a front of the receiving chamber being located between the two side boards, at least one portion of the front surface of the base body protruding frontward to form at least one sealing board connected with rears of the two side boards, a front end of the at least one sealing board opening a locking groove, a rear of the insulating housing being fastened in the receiving chamber, a front of the insulating housing being received between fronts of the two side boards, the front ends of the conductive terminals being exposed out of the shielding element, the rear ends of the conductive terminals projecting out of the shielding element, the at least one sealing board being attached to a substantial middle of the insulating housing and located behind the protruding portion, the protruding portion being received in the locking groove and sealing up the front end of the at least one sealing board.

2. The receptacle connector as claimed in claim 1, wherein the insulating housing includes a main portion and a tongue portion, the receiving chamber includes a first receiving chamber and a second receiving chamber, a rear of the base body opens the first receiving chamber passing through the rear surface of the base body, a front wall of the first receiving chamber opens the second receiving chamber passing through the front surface of the base body, the second receiving chamber is located in front of and communicated with the first receiving chamber, a front of the main portion is received in the first receiving chamber, a rear of the tongue portion is received in the second receiving chamber, the tongue portion is fastened to the front of the main portion, the second receiving chamber is located between the two side boards, a front of the tongue portion is received between the two side boards.

3. The receptacle connector as claimed in claim 2, wherein the tongue portion has the at least one docking surface, the at least one sealing board is attached to a rear of the at least one docking surface, the conductive terminals are fastened to the main portion and transversely arranged along the at least one docking surface, the front ends of the plurality of the conductive terminals project beyond a front surface of the main portion and fastened to the tongue portion, the front ends of the conductive terminals are exposed to the front of the at least one docking surface of the tongue portion and are transversely arranged along the at least one docking surface, the rear ends of the plurality of conductive terminals project beyond a rear surface of the main portion.

4. The receptacle connector as claimed in claim 2, wherein the tongue portion has a limiting portion, and a docking portion protruded frontward from a front surface of the limiting portion, the docking portion has a first docking portion protruded frontward from the front surface of the limiting portion, and a second docking portion protruded frontward from a front face of the first docking portion, the limiting portion is fastened in the second receiving chamber, the docking portion is received between the two side boards.

5. The receptacle connector as claimed in claim 4, wherein the insulating housing has two opposite docking surfaces, an upper portion of the front surface of the base body protrudes frontward to form a first sealing board of which two opposite sides are connected with rears of top surfaces of the two side boards, a lower portion of the front surface of the base body protrudes frontward to form a second sealing board opposite to and spaced from the first sealing board, two opposite sides of the second sealing board are connected with rears of bottom surfaces of the two side boards, the first sealing board is attached to a rear of one of the two opposite docking surfaces, the second sealing board is attached to a rear of the other docking surface.

6. The receptacle connector as claimed in claim 5, wherein a top surface and a bottom surface of the docking portion are defined as the two opposite docking surfaces, one of the two opposite docking surfaces includes a top face of the first docking portion extending longitudinally, the other docking surface includes a bottom face of the first docking portion opposite to the top face of the first docking portion, the first sealing board is attached to a rear of the top face of the first docking portion, the second sealing board is attached to a rear of the bottom face of the first docking portion.

7. The receptacle connector as claimed in claim 6, wherein substantial middles of the two opposite docking surfaces protrude outward to form two protruding portions beyond the two opposite docking surfaces, respectively, the two protruding portions include a first protruding portion and a second protruding portion, front ends of the top face and the bottom face of the first docking portion protrude outward to form the first protruding portion and the second protruding portion, respectively, a middle of a front end of the first sealing board opens a first locking groove, a middle of a front end of the second sealing board opens a second locking groove, the first protruding portion is received in the first locking groove and seals up the front end of the first sealing board, the second protruding portion is received in the second locking groove and seals up the front end of the second sealing board.

8. The receptacle connector as claimed in claim 5, wherein substantial middles of the two opposite docking surfaces protrude outward to form two protruding portions beyond the two opposite docking surfaces, respectively, the two protruding portions include a first protruding portion and a second protruding portion, a middle of a front end of the first sealing board opens a first locking groove, a middle of a front end of the second sealing board opens a second locking groove, the first protruding portion is received in the first locking groove and seals up the front end of the first sealing board, the second protruding portion is received in the second locking groove and seals up the front end of the second sealing board.

9. The receptacle connector as claimed in claim 8, wherein the plurality of conductive terminals include a plurality of upper terminals and a plurality of lower terminals fastened to the insulating housing, rear ends of the upper terminals and the lower terminals project beyond the rear surface of the insulating housing, front ends of the upper terminals are exposed to one of the two opposite docking surfaces and located in front of the first protruding portion, front ends of the lower terminals are exposed to the other docking surface and located in front of the second protruding portion.

10. The receptacle connector as claimed in claim 9, wherein the tongue portion opens a plurality of terminal grooves arranged in two rows along an up-down direction, each row of the terminal grooves are arranged transversely, the two rows of the terminal grooves include a row of upper terminal grooves vertically penetrating through a superface of the second docking portion, and a row of lower terminal grooves vertically penetrating through a subface of the second docking portion and located under the row of the upper terminal grooves, each of the upper terminals has an upper contact portion, front ends of the upper contact portions are exposed to the superface of the second docking portion and are arranged transversely, each of the lower terminals has a lower contact portion, front ends of the lower contact portions are exposed to the subface of the second docking portion and are arranged transversely.

11. The receptacle connector as claimed in claim 2, wherein the tongue portion opens a plurality of terminal grooves longitudinally extending and penetrating through a rear surface of the tongue portion, and penetrating through the front of the at least one docking surface, the terminal grooves are located in front of the protruding portion and transversely arranged along the at least one docking surface, the front ends of the conductive terminals are inserted into the terminal grooves, the front ends of the conductive terminals are exposed to the front of the at least one docking surface from front ends of the respective terminal grooves and are transversely arranged along the at least one docking surface.

12. The receptacle connector as claimed in claim 2, wherein the main portion has a base portion, and a connecting portion protruded frontward from a middle of a front surface of the base portion, the connecting portion is received in the first receiving chamber, the plurality of conductive terminals are fastened to the base portion and the connecting portion and transversely arranged along the at least one docking surface, the front ends of the plurality of conductive terminals project beyond a front surface of the connecting portion, the rear ends of the plurality of conductive terminals project beyond a rear surface of the base portion.

13. The receptacle connector as claimed in claim 2, further comprising at least one ground terminal which has a fixing portion, a touching portion connected with one end of the fixing portion, and a soldering foot connected with the other end of the fixing portion, the at least one ground terminal being fastened to the insulating housing, a front end of the at least one ground terminal projecting beyond a front surface of the main portion, a rear end of the at least one ground terminal projecting beyond the rear surface of the insulating housing.

14. The receptacle connector as claimed in claim 13, wherein the receptacle connector includes two upper ground terminals, each of which has an upper fixing portion, an upper touching portion connected with one end of the upper fixing portion, and an upper soldering foot connected with the other end of the upper fixing portion, the main portion includes an upper insulating body which has an upper base portion, and an upper connecting portion protruded frontward from a lower portion of a front surface of the upper base portion, two opposite sides of a front surface of the upper connecting portion are recessed inward to form two upper gaps, rear ends and middles of the upper fixing portions and front ends of the upper soldering feet are molded in the upper insulating body, front ends of the upper fixing portions are fastened in the two upper gaps, rear ends of the upper soldering feet project beyond a rear surface of the upper base portion, the upper touching portions project beyond a top surface of the upper connecting portion.

15. The receptacle connector as claimed in claim 14, wherein a free end of the upper touching portion is bent downward and rearward, and then is arched downward to form an upper touching point approaching to a root portion of the upper soldering foot, the upper touching points of the two upper ground terminals abut against an inner surface of a top wall of the receiving chamber.

16. The receptacle connector as claimed in claim 14, wherein the upper fixing portion is shown as a substantially U shape with the mouth thereof facing upward, the upper fixing portion has a first arm, and a second arm inclined outward away from the first arm and located behind the first arm, the upper touching portion is slantwise extended upward and rearward from the first arm, and located above the inclined second arm and the middle of the upper fixing portion, the upper soldering foot is bent rearward, then slantwise extends rearward and sideward, and further extends rearward from the second arm, the first arms of the upper fixing portions are fastened in the two upper gaps, respectively.

17. The receptacle connector as claimed in claim 13, wherein the receptacle connector includes two lower ground terminals, each of which has a lower fixing portion, a lower touching portion connected with one end of the lower fixing portion, and a lower soldering foot connected with the other end of the lower fixing portion, the main portion includes a lower insulating body which has a lower base portion, and a lower connecting portion protruded frontward from an upper portion of a front surface of the lower base portion, two opposite sides of a front surface of the lower connecting portion are recessed inward to form two lower gaps, rear ends and middles of the lower fixing portions and front ends of the lower soldering feet of the two lower ground terminals are molded in the lower insulating body, front ends of the lower fixing portions are fastened in the two lower gaps, rear ends of the lower soldering feet of the two lower ground terminals project beyond the rear surface of the lower base portion, the lower touching portions of the two lower ground terminals project beyond a top surface of the lower connecting portion.

18. The receptacle connector as claimed in claim 17, wherein a free end of the lower touching portion is bent upward and rearward, and then is arched upward to form a lower touching point approaching to a root portion of the lower soldering foot, the lower touching points of the two lower ground terminals abut against an inner surface of a bottom wall of the receiving chamber.

19. The receptacle connector as claimed in claim 17, wherein the lower fixing portion is shown as a substantially inverted U shape with the mouth thereof facing downward, the substantially lower fixing portion has a third arm, and a fourth arm inclined outward away from the third arm and located behind the third arm, the lower touching portion is slantwise extended downward and rearward from the third arm and located under the inclined fourth arm and the middle of the lower fixing portion, the lower soldering foot is bent rearward in a direction away from the third arm, then slantwise extends rearward and sideward, and further extends rearward from the fourth arm, the third arms of the lower fixing portions are fastened in the two lower gaps, respectively.

20. The receptacle connector as claimed in claim 1, wherein the shielding element further has a connecting board connected between front ends of the two side boards, the connecting board is fastened in the front of the insulating housing.

* * * * *